US005441859A

United States Patent [19]

Yabuki et al.

[11] Patent Number: 5,441,859

[45] Date of Patent: Aug. 15, 1995

[54] SILVER HALIDE PHOTOGRAPHIC MATERIAL

[75] Inventors: Yoshiharu Yabuki; Keiichi Suzuki, both of Kanagawa, Japan

[73] Assignee: Fuji Photo Film Co., Ltd., Kanagawa, Japan

[21] Appl. No.: 305,451

[22] Filed: Sep. 13, 1994

[30] Foreign Application Priority Data

Sep. 14, 1993 [JP] Japan ..... 5-228397

[51] Int. Cl.[6] ..... G03C 1/40

[52] U.S. Cl. ..... 430/522; 430/510

[58] Field of Search ..... 430/510, 522, 507

[56] References Cited

U.S. PATENT DOCUMENTS

| | | | |
|---|---|---|---|
| 4,179,294 | 12/1979 | Sugiyama et al. | 430/522 |
| 5,238,798 | 8/1993 | Usami | 430/522 |
| 5,238,799 | 8/1993 | Usami et al. | 430/522 |
| 5,356,766 | 10/1994 | Idogaki | 430/522 |

*Primary Examiner*—Lee C. Wright

*Attorney, Agent, or Firm*—Sughrue, Mion, Zinn, Macpeak & Seas

[57] ABSTRACT

A silver halide photographic material having a hydrophilic colloid layer containing a dispersion of fine solid grains of at least one compound represented by formula (1)

(1)

wherein

R represents an alkyl group, an aryl group, an amino group, an alkoxy group, an aryloxy group or a heterocyclic group;

$L_1$, $L_2$ and $L_3$ each represents a methine group;

Y represents a hydrogen atom, an alkyl group, an alkoxy group or a halogen atom;

R and Y may be bonded to each other to form a ring; and n represents an integer of from 0 to 2;

provided that R, Y, $L_1$, $L_2$ and $L_3$ do not have a group having an ionizable proton or its salt.

5 Claims, No Drawings

SILVER HALIDE PHOTOGRAPHIC MATERIAL

FIELD OF THE INVENTION

The present invention relates to a silver halide photographic material having a colored hydrophilic colloid layer and, in particular, to a silver halide photographic material having a hydrophilic colloid layer containing a dye which is photochemically inactive and has excellent light-absorbing characteristics while being easily decolored and/or dissolved out by development so as not to cause color stains in the processed material.

BACKGROUND OF THE INVENTION

In preparing silver halide photographic materials, coloration of photographic emulsion layers and other hydrophilic colloid layers is often effected for the purpose of absorbing lights falling within a particular wavelength range.

If it is necessary to control the spectral composition of the light to penetrate into photographic emulsion layers, a colored layer is provided on the support more remotely from the support than photographic emulsion layers. The colored layer is called a filter layer. In the case of a multi-layered color photographic material having plural photographic emulsion layers, the filter layer may be positioned in the intermediate between them.

For the purpose of preventing blur of images to be caused by re-penetration of the light as once scattered during or after passing through photographic emulsion layers and reflected on the interface between the emulsion layer and the support or on the surface of the photographic material opposite to the emulsion layer, into the photographic emulsion layers, or for the purpose of preventing such halation, a colored layer may be provided between the photographic emulsion layer and the support or on the surface of the support opposite to the photographic emulsion layer. The colored layer is called an anti-halation layer. In the case of a multi-layered color photographic material, the anti-halation layer may be provided in the intermediate between the respective layers.

For the purpose of preventing lowering of the image sharpness to be caused by scattering of light in photographic emulsion layers (the phenomenon is generally called "irradiation"), coloration of photographic emulsion layers is often effected.

The layers to be colored for these purposes are hydrophilic colloid layers and, in general, dyes are incorporated into the layers so as to color them. The dyes need to satisfy the following conditions.

(1) They have a pertinent spectral absorption in accordance with the use and the object.

(2) They are photochemically inactive. That is to say, they do not have any harmful influences on the chemical properties of silver halide photographic emulsion layers. For example, they do not lower the sensitivity of the emulsion layers, they do not cause latent image fading and they do not cause fogging.

(3) They are decolored or dissolved out in the step of photographic processing or rinsing so that they do not give any harmful color stains to the processed photographic materials.

(4) They do not diffuse from the layer as dyed with them to any other layers.

(5) They have an excellent storage stability in solutions or in photographic materials and are neither discolored nor faded during storage.

In particular, where the colored layer is a filter layer or it is an anti-halation layer to be positioned on the same side of the support as that having photographic emulsion layers thereon, it is often necessary that such a filter layer or anti-halation layer only is selectively colored in such a way that coloration of the layer does not substantially extend to any other layers. This is because, if not, not only the colored filter layer or anti-halation layer will have any harmful spectral effect on the other layers but also the effect of the intended filter layer or anti-halation layer will be lowered. Also for anti-irradiation, it is necessary to selectively color only the desired emulsion layer in order that the dye coloring the layer does not have any harmful influence on the other layers while being able to sufficiently display the intended function of itself. However, when the dye-added layer is brought into contact with any other hydrophilic colloid layer while they are still wet, a part of the dye in the former layer will often diffuse to the latter layers. In order to prevent such diffusion of dyes, various efforts have hitherto been made.

For instance, a method of incorporating a hydrophilic polymer as charged oppositely to the dissociated anionic dye into a layer as a mordant agent along with the dye so that the dye is localized to a particular layer because of the interaction between the polymer and dye molecule is illustrated in U.S. Pat. Nos. 2,548,564, 4,124,386 and 3,525,694.

A method of dyeing a particular layer with dye-adsorbed fine metal salt grains is illustrated in U.S. Pat. Nos. 2,719,088, 2,496,841 and 2,496,843 and JP-A-60-45237 (the term "JP-A" as used herein means an "unexamined published Japanese patent application").

A method of dyeing a particular layer with a water-insoluble dye is illustrated in JP-A-55-120030, JP-A-56-12639, JP-A-55-155350, JP-A-55-155351, JP-A-63-27838, JP-A-63-197943 and JP-A-52-92716, European Patent Publications 15601, 323729, 274723, 276566 and 299435 and International Patent Laid-Open No. 88/04794.

However, even though such improved methods are employed, there are still various problems. Precisely, dyes are often diffused in the dye-fixed layer; the decoloring rate during development is often low; and where the conditions of processing photographic materials are changed, for example, by employing rapid processing system, employing modified processing compositions or employing modified photographic emulsion compositions, the decoloring mechanism could not always sufficiently be displayed.

As a means for overcoming these problems, there is illustrated a method of using a dispersion of fine solid grains of a 2-pyrazolin-5-one-oxonole dye having 1-positioned hydrogen in JP-A-4-37740 and JP-A-4-127143 (corresponding to U.S. Pat. No. 5,238,799). According to this method, the above-mentioned problems about the diffusion of dyes in dye-fixed layers and the decoloration of dyes by development were overcome to a certain extent. However, the dyes concretely illustrated in these patent publications were not still satisfactory enough to practically overcome these two problems. In addition, since the dispersion of fine solid grains of these dyes generally has a broad light absorption, its use is limited. Accordingly, there still remained room for further improvement in the absorbing characteristics of these dyes.

SUMMARY OF THE INVENTION

An object of the present invention is to provide a photographic material which contains a dye in the form of a dispersion of fine solid grains thereof, the dye being so planned that it colors only a defined hydrophilic colloid layer in the material, that it does not diffuse to any other layers therein during storage of the material and that it is rapidly decolored by development of the material.

Another object of the present invention is to provide a photographic material which contains a dispersion of fine solid grains of a dye having excellent light absorption characteristics.

The object of the present invention can be attained by a silver halide photographic material having a hydrophilic colloid layer which contains a dispersion of fine solid grains of at least one compound represented by formula (1)

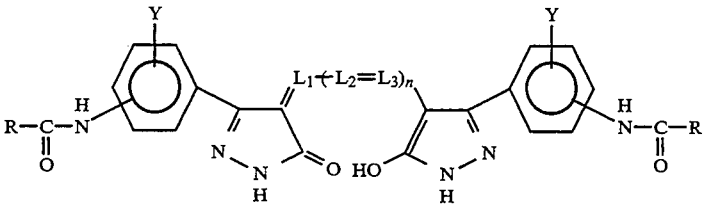

(1)

wherein

R represents an alkyl group, an aryl group, an amino group, an alkoxy group, an aryloxy group or a heterocyclic group;

$L_1$, $L_2$ and $L_3$ each represents a methine group;

Y represents a hydrogen atom, an alkyl group, an alkoxy group or a halogen atom;

R and Y may be bonded to each other to form a ring; and n represents an integer of from 0 to 2;

provided that R, Y, $L_1$, $L_2$ and $L_3$ do not have a group having an ionizable proton or its salt.

DETAILED DESCRIPTION OF THE INVENTION

Next, dyes of formula (1) will be explained in detail hereunder.

R represents an alkyl group, an aryl group, an amino group, an alkoxy group, an aryloxy group or a heterocyclic group, and it is preferably an alkyl group or an amino group. The alkyl group of R may have a substituent (e.g., an alkyl group, an alkoxy group, a hydroxyl group, a halogen atom), and preferably has from 1 to 6 carbon atoms inclusive of carbon number of its substituent. Examples of the alkyl group of R include a methyl group, an ethyl group, a n-propyl group, an iso-propyl group, a n-butyl group, a tert-butyl group, a n-hexyl group and a cyclohexyl group. The aryl group of R may have a substituent (e.g., an alkyl group, an alkoxy group, an acylamino group, a halogen atom), and preferably has from 6 to 10 carbon atoms inclusive of carbon number of its substituent. Examples of the aryl group of R include a phenyl group and a naphthyl group, preferably a phenyl group. The amino group of R may have a substituent (e.g., an alkyl group, an aryl group). Examples of the amino group of R include an amino group, a methyl amino group and a dimethyl amino group. The alkoxy group of R may have a substituent (e.g., an alkyl group, an alkoxy group), and preferably has from 1 to 6 carbon atoms inclusive of carbon number of its substituent. Examples of alkoxy group of R include a methoxy group, an ethoxy group, a n-propoxy group, an iso-propoxy group, a n-butoxy group, a tert-butoxy group and a n-hexyloxy group. The aryloxy group of R may have a substituent, and preferably has from 6 to 10 carbon atoms inclusive of carbon number of its substituent. A preferred example of the aryloxy group of R includes a phenoxy group. The heterocyclic group of R may have a substituent, and preferably has from 4 to 10 carbon atoms inclusive of carbon number of its substituent. Preferred examples of heterocyclic group of R include a pyridyl group, a furano group and a thienyl group. The heterocyclic group of R has from 1 to 3 hetero atoms (e.g., a nitrogen atom, an oxygen atom, a sulfur atom).

$L_1$, $L_2$ and $L_3$ each represents a methine group, which may have substituent(s) (e.g., an alkyl group preferably having from 1 to 4 carbon atoms, an amino group, a halogen atom). Two methine groups of these may be bonded to each other to form a 5-membered or 6-membered ring. Y represents a hydrogen atom, an alkyl group, an alkoxy group or a halogen atom. The alkyl group and the alkoxy group of Y have the same meanings as those of R. Y is preferably a hydrogen atom. R and Y may be bonded to each other to form a ring provided that R and Y have from 0 to 2 carbon atoms in total. n represents an integer of from 0 to 2.

R, Y, $L_1$, $L_2$ and $L_3$ do not have a group having an ionizable proton or its salt. Examples of the group having ionizable proton or its salt include a sulfo group, a carboxyl group, a phenolic hydroxyl group, a sulfamoyl group and a sulfonamide group.

In formula (1), each

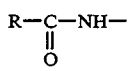

group preferably connects to the benzene nucleus at para-position of the pyrazoline nucleus.

Specific examples of preferred compounds of formula (1) for use in the present invention are mentioned below, which, however, are not limitative.

1
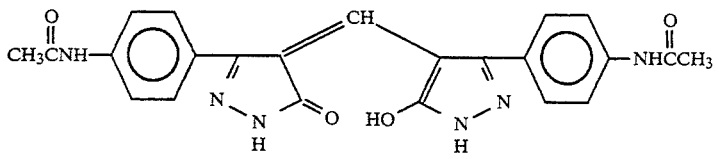
2
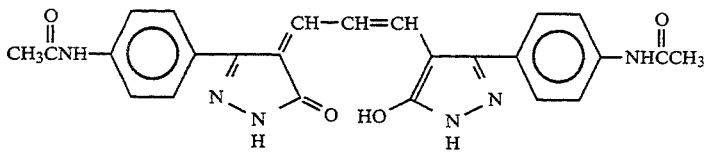
3
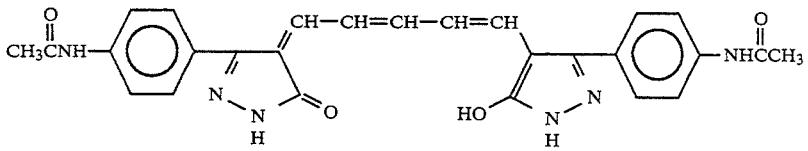
4
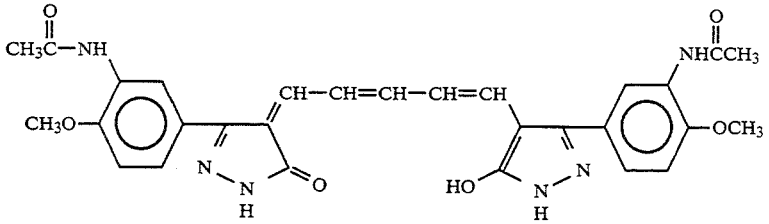
5
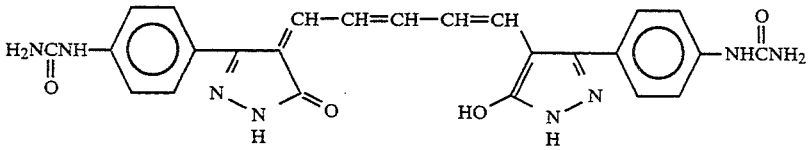
6
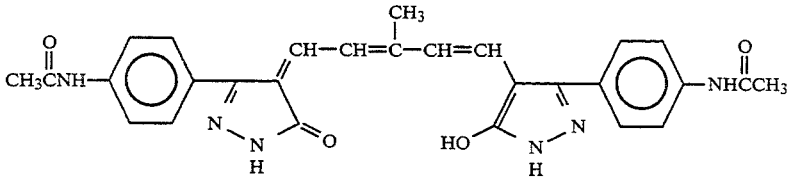
7
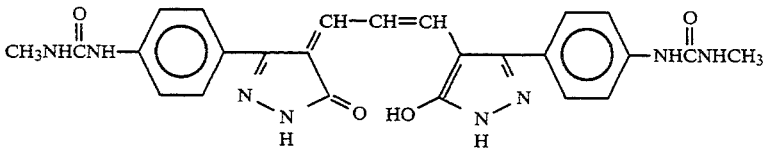
8
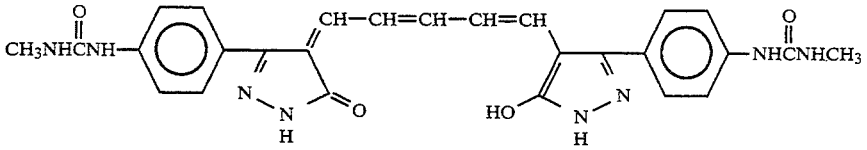
9
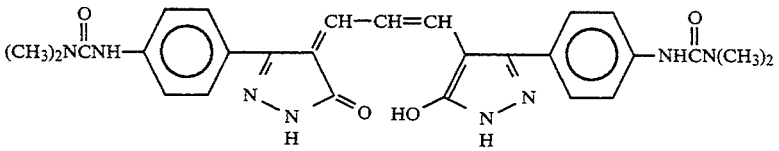

-continued
10
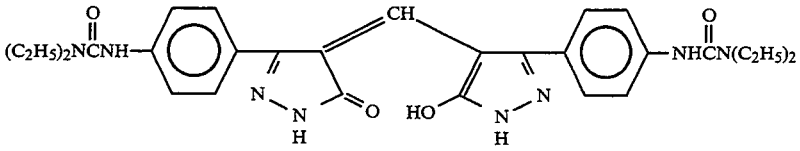
11
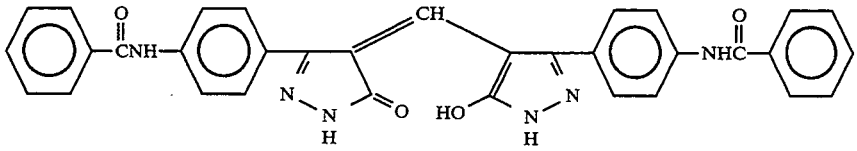
12
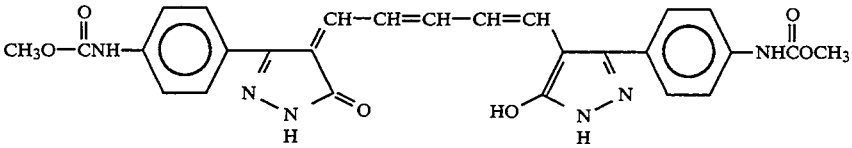
13
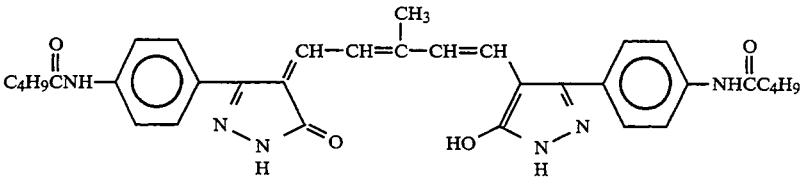
14
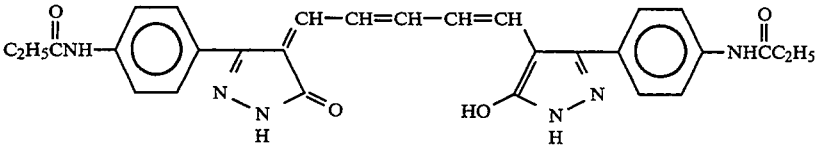
15
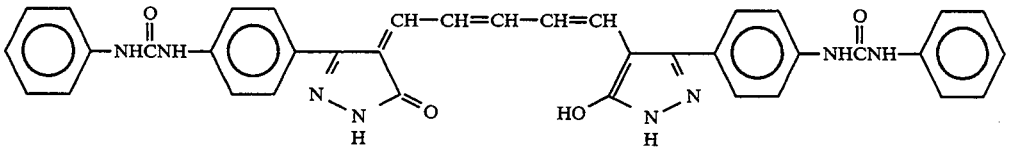
16
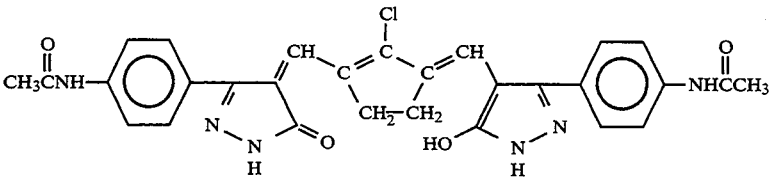
17
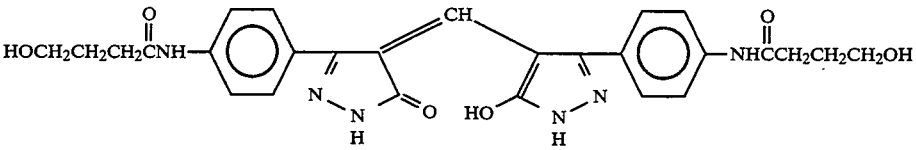
18
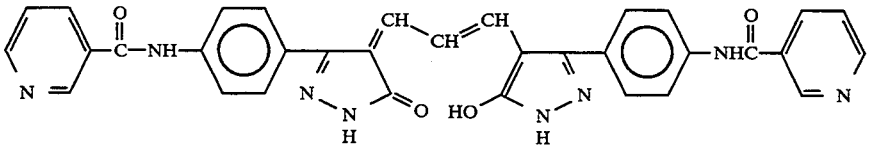

-continued

19

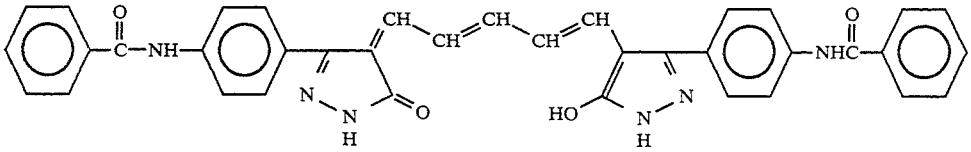

20

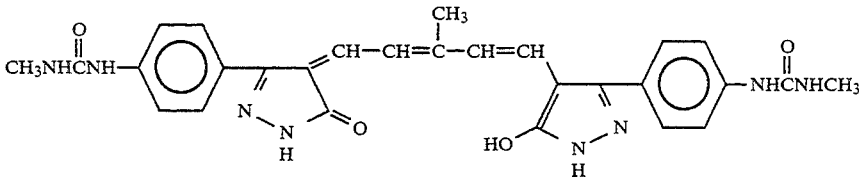

21

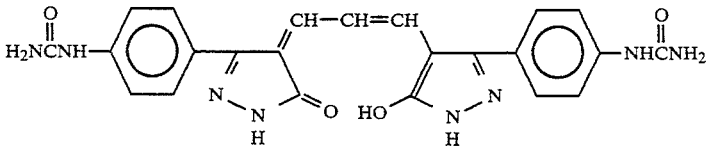

22

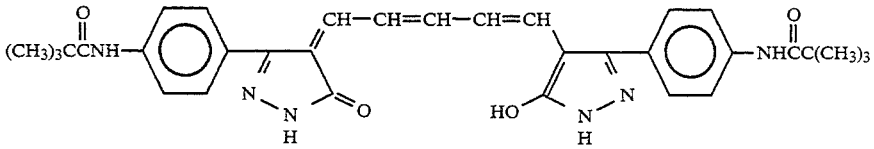

23

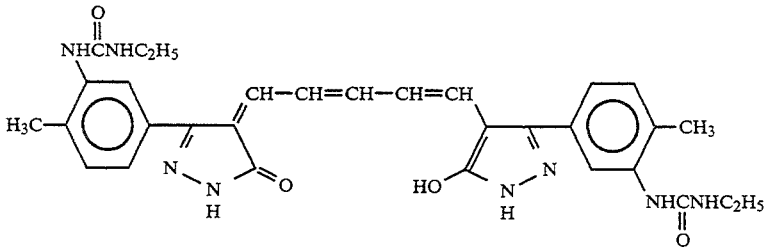

24

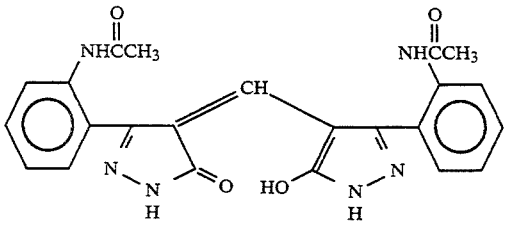

Of them, Compound Nos. 1, 2, 3, 5, 6, 7 and 8 are preferred.

Synthetic Example 1

Production of Compound No. 3:

21.7 g of 3-(4-acetylaminophenyl)-2-pyrazolin-5-one were dissolved in 220 ml of DMF, and 11.9 g of pentadiene-dianil hydrochloride and 20 ml of triethylamine were added thereto and stirred at 50° C. for 6 hours. A dilution prepared by diluting 23.8 ml of hydrochloric acid with 49 ml of methanol was added thereto at 40° C., and the solid precipitated out was taken out by filtration. This was fully washed with methanol and then water. The thus-obtained solid was used, while it was a wet cake, to prepare its dispersion. The yield of the product was 12.5 g, calculated in terms of its dry solid.

Synthetic Example 2

Production of Compound No. 7:

The same process as in Synthetic Example 1 was repeated, except that 3-(4-acetylaminophenyl)-2-pyrazolin-5-one was replaced by 3-(4-methylaminocarbonylaminophenyl)-2-pyrazolin-5-one and pentadiene-dianil hydrochloride by propene-dianil hydrochloride. 23.8 ml of hydrochloric acid were added to the reaction mixture and then 440 ml of water were added thereto. The solid precipitated out was taken out by filtration and then treated in the same manner as in Synthetic Example 1. The yield of the product was 15.2 g, calculated in terms of its dry solid.

Dispersion of compounds of formula (1) may be effected by known grinding methods (for example, using a ball mill, a shaking ball mill, a planet ball mill, a sand mill, a colloid mill, a jet mill, a roller mill). In these methods, it is preferred to use a solvent (e.g., water) more preferably along with a surfactant for dispersion. Additionally, as still another employable method, the dye of the invention is dissolved in a pertinent solvent and then a poor solvent is added to the resulting solution so as to precipitate the dye as its fine crystals. Also in this case, a surfactant for dispersion may be used, if desired. As still another employable method, the dye of the invention is first dissolved in a solvent with controlling the pH value of the resulting solution and thereafter the pH value of the solution is varied so as to form fine crystals of the dye.

In the form of the thus-formed dispersion, the grain size of the fine grains of the compound of formula (1) according to the present invention may be 10 μm or less (and preferably 0.01 μm or more), preferably 1 μm or less, especially preferably 0.5 μm or less. As the case may be, it is especially preferably in the form of fine grains having a grain size of 0.1 μm or less. The fine grains of the dye are preferably mono-dispersed.

The solid compound (dye) of formula (1) may directly be dispersed without being pre-treated prior to the dispersion. Preferably, a wet cake of the solid dye to be obtained during the process of producing it is directly dispersed.

If desired, the dye may be heated before and/or after its dispersion. More effectively, it is heated at least after its dispersion.

The heating method is not specifically limited, provided that heat may be applied to the solid dye. The heating temperature is preferably 40° C. or higher, and its upper limit is not defined provided that it falls within a temperature range at which the dye is not decomposed. Preferably, the upper limit is 250° C. or lower. More preferably, the heating temperature falls within the range of from 50° C. to 150° C.

The heating time is not also specifically defined, provided that the dye is not decomposed during heating. For example, it may be from 15 minutes to 2 weeks, preferably from 1 hour to 8 days.

In order to effectively attain the heat treatment, the dye is preferably heated in a solvent. The kind of the solvent to be used for this purpose is not specifically defined, provided that it does not substantially dissolve the compounds of formula (1). For instance, usable are water, alcohols (e.g., methanol, ethanol, isopropyl alcohol, butanol, isoamyl alcohol, octanol, ethylene glycol, diethylene glycol, ethyl cellosolve), ketones (e.g., acetone, methyl ethyl ketone), esters (e.g., ethyl acetate, butyl acetate), alkylcarboxylic acids (e.g., acetic acid, propionic acid), nitriles e.g., acetonitrile), ethers ( e.g., dimethoxyethane, dioxane, tetrahydrofuran), etc.

Where organic carboxylic acids are employed during the heat treatment, the object of the present invention may be attained more effectively. As usable organic carboxylic acids, mentioned are alkylcarboxylic acids (e.g., acetic acid, propionic acid), carboxymethyl celluloses (CMC), arylcarboxylic acids (e.g., benzoic acid, salicylic acid), etc.

The amount of the organic carboxylic acid, when it is used as the solvent, may be from 0.5 to 100 times the weight of the compound of formula (1). When a solvent except organic carboxylic acids are used and a carboxylic acid is added to the solvent, the amount of the carboxylic acid to be added may be from 0.05 to 100% by weight relative to the compound of formula (1).

According to the present invention, the compound of formula (1) may be employed in any desired effective amount. Preferably, it is employed in such an amount that its optical density may fall within the range of from 0.05 to 3.0. Concretely, the amount of the compound to be added is preferably from 0.5 mg/m$^2$ to 1000 mg/m$^2$, more preferably from 1 mg/m$^2$ to 500 mg/m$^2$. The time for adding the compound may be any time before coating.

The compound of formula (1) may be added to any of emulsion layers and other hydrophilic colloid layers (interlayer, protective layer, anti-halation layer, filter layer, etc.) and may be added to one layer or plural layers.

As hydrophilic colloids, gelatin is typically used but any others known usable in photography may also be used in the present invention.

The silver halide emulsion of constituting the photographic material of the present invention is preferably made of silver bromide, silver iodide, silver iodobromide, silver iodochlorobromide, silver chlorobromide or silver chloride.

The silver halide grains for use in the present invention are regular crystalline grains such as cubic or octahedral crystal grains, or irregular crystalline grains such as spherical or tabular crystalline grains, or composite crystalline grains composed of such regular and irregular crystalline grains. Further, mixtures comprising various crystalline grains may also be used. Preferably, regular crystalline grains are used.

Silver halide grains, photographic emulsions, methods of preparing them, binders, protective colloids, hardening agents, sensitizing dyes, stabilizers and antifoggants are described in JP-A-3-238447, from page 18, left bottom column, line 18 to page 20, left bottom column, line 17. These may apply to the present invention.

The photographic material of the present invention may contain one or more surfactants as coating aids, antistatic agents, sliding property-improving agents, emulsifying and dispersing agents, anti-blocking agents, agents for improving photographic properties (for example, for development acceleration, contrast elevation, sensitization) , etc.

The photographic material of the present invention may contain other various dyes except the dyes of the present invention, in its hydrophilic colloid layers, as filter dyes or for anti-irradiation or anti-halation or for other various purposes. As such dyes, preferably used are oxonole dyes, hemioxonole dyes, styryl dyes, merocyanine dyes, anthraquinone dyes and azo dyes. In addition to these, also usable are cyanine dyes, azomethine dyes, triarylmethane dyes and phthalocyanine dyes. Where these are soluble in water, they may be used as their aqueous solutions. Where these are hardly soluble in water, they may be used as dispersions of their fine solid grains. Where they are oil-soluble ones, they may be emulsified by an oil-in-water dispersion method and the resulting emulsions may be added to the desired hydrophilic colloid layers.

Multi-layered multi-color photographic materials, supports, methods of coating photographic emulsion layers, means for exposing photographic materials, and means for processing photographic materials are described in JP-A-3-238447, from page 20, right bottom column, line 14 to page 27, right top column, line 2. These may apply to the present invention.

The silver halide photographic material of the present invention have an excellent effect in that the dyes added to the dye layer of the material have suitable color absorption and they may selectively color only the intended dye layer without diffusing to any other layers.

As the advantage of the compounds of the present invention, they may easily decolor or dissolve out of the silver halide photographic material containing them by development of the material, while giving a low Dmin without lowering the sensitivity of the material. In addition, as further advantage of the photographic material of the present invention, its sensitivity is not lowered during its storage.

Moreover, the silver halide photographic material of the present invention gives an image having an improved sharpness. In addition, the photographs to be obtained from the silver halide photographic material of the present invention do not have stains and are stable for a long period of time without lowering their photographic properties even though stored long.

The present invention will be explained more concretely with reference to the following examples, which, however, are not intended to restrict the scope of the present invention.

EXAMPLE 1

The dye shown in Table 1 was prepared as its solid dispersion according to the method mentioned below.

Precisely, 2.5 g of the dye, 7.5 g of an aqueous 10% solution of a surfactant (Demol SNB—trade name—sold by Kaoh Co.) and 53.3 g of water were previously mixed by stirring, put in an Aiger Motor Mill (M-50 Model, made by Aiger Japan Co.) having therein 40 cc of zirconia beads having a diameter of from 0.8 mm to 1.2 mm and dispersed at a rotation of 4500 r.p.m. to obtain a solid dispersion of the dye having a grain size of 1 μm or less.

TABLE 1

| Sample No. | Dispersed Solid Dye | |
|---|---|---|
| 1 | Compound No. 1 | sample of the invention |
| 2 | Compound No. 2 | sample of the invention |
| 3 | Compound No. 3 | sample of the invention |
| 4 | Compound No. 7 | sample of the invention |
| 5 | Compound No. 8 | sample of the invention |
| 6 | Comparative Compound No. 1 | comparative sample |
| 7 | Comparative Compound No. 2 | comparative sample |
| 8 | Comparative Compound No. 3 | comparative sample |
| 9 | Comparative Compound No. 4 | comparative sample |
| 10 | Comparative Compound No. 5 | comparative sample |

Comparative Compound No. 1 (described in JP-A 4-127143):

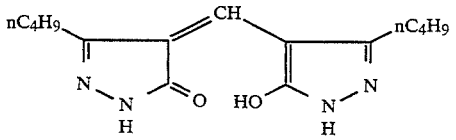

Comparative Compound No. 2:

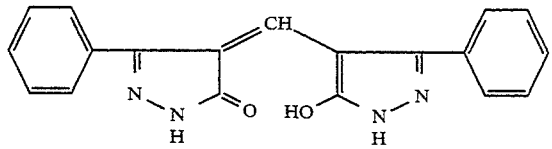

Comparative Compound No. 3:

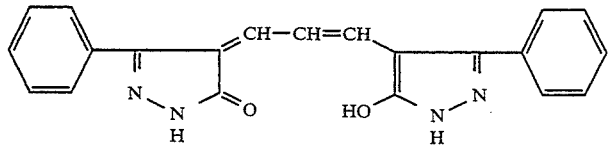

Comparative Compound No. 4:

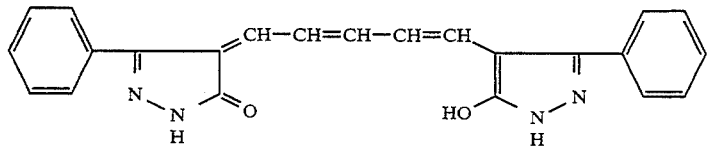

Comparative.Compound No. 5:

TABLE 1-continued

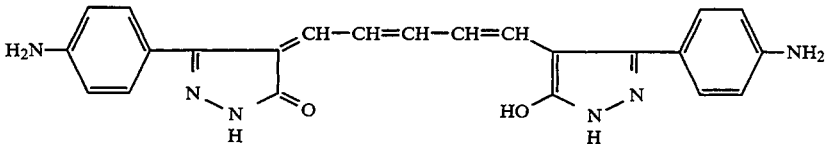

Preparation of Samples:

On a 180 μm-thick, transparent polyethylene terephthalate support that had been coated with a subbing layer, coated were 0.07 g/m$^2$ (as solid content) of the solid dispersion of the dye, 3 g/m$^2$ of gelatin and, as a hardening agent, 0.06 g/m$^2$ of 1,2-bis(vinylsulfonylacetamido)ethane, and dried to prepare sample films (Nos. 1 to 10).

Evaluation of the Degree of Fixation of the Dye:

The thus-prepared sample films were dipped in a phosphoric acid buffer having pH of 5 for 5 minutes, then rinsed with running water for 30 seconds and dried, and the absorbance of each sample was measured.

The ratio of the absorbance of the thus-treated sample film to that of the non-treated sample film was obtained to be the degree of fixation of the dye on the sample film, which was represented in terms of %. This is shown in Table 2. It is desired that the degree of fixation of the dye is high in a neutral to weakly acidic range.

Determination of the Degree of Color Stains:

The thus-prepared sample films were dipped in a phosphoric acid buffer having pH of 10.0 and containing 10 g/liter of sodium sulfite for 45 seconds, while bubbling with air, then dipped in an aqueous 5% acetic acid solution for 30 seconds, subsequently rinsed with running water for 30 seconds and dried. The absorbance of each of the thus-treated sample films was measured. The ratio of the absorbance of the thus-treated sample film to that of the non-treated sample film was obtained to be the degree of color stains on the sample film, which was represented in terms of %. This is shown in Table 2. It is desired that the degree of color stains is low in an aqueous high-pH solution.

TABLE 2

| Sample No. | Degree of Fixation of Dye (%) | Degree of Color Stains (%) | |
|---|---|---|---|
| 1 | 100 | 1 | sample of the invention |
| 2 | 100 | 1 | sample of the invention |
| 3 | 100 | 2 | sample of the invention |
| 4 | 100 | 2 | sample of the invention |
| 5 | 100 | 2 | sample of the invention |
| 6 | 97 | 6 | comparative sample |
| 7 | 78 | 10 | comparative sample |
| 8 | 79 | 11 | comparative sample |
| 9 | 85 | 12 | comparative sample |
| 10 | 79 | 13 | comparative sample |

From the results in Table 2, it is understood that the solid dispersions of the dyes according to the present invention are more desirable than the conventional ones in that the former had a higher degree of fixation and a lower degree of color stains than the latter.

EXAMPLE 2

Preparation of Emulsion:

An aqueous silver nitrate solution and an aqueous sodium chloride solution were simultaneously mixed with an aqueous gelatin solution kept at 40° C. in the presence of $5.0\times10^{-6}$ mol, per mol of silver, of $(NH_4)_3RhCl_6$ and the soluble salts were removed therefrom and gelatin was added thereto by a method well known in this technical field. Without chemically ripening this, a stabilizer of 2-methyl-4-hydroxy-1,3,3a,7-tetrazaindene was added thereto. The emulsion thus prepared was a monodispersed emulsion of cubic grains having a mean grain size of 0.15 μm.

To the emulsion, added were the following hydrazine derivative (as its 2% methanolic solution), the following mercaptotetrazole derivative (as its 1% aqueous solution), polyethyl acrylate latex (30 wt.%, relative to gelatin, of its solid content) and, as a hardening agent, 1,3-vinylsulfonyl-2-propanol. This was coated on a polyester support in an amount of 3.8 g/m$^2$ as Ag.

The amount of gelatin coated was 1.8 g/m$^2$.

Hydrazine Derivative:

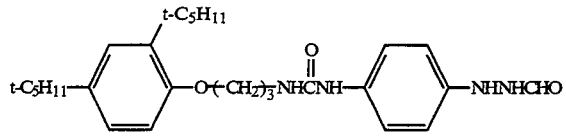

$1.1\times10^{-4}$ mol/m$^2$

Mercaptotetrazole Derivative:

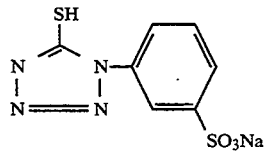

$1.5\times10^{-5}$ mol/m$^2$

The support used above had the following backing layer and backing layer-protecting layer.

| Composition of Backing Layer: | |
|---|---|
| Gelatin | 170 mg/m$^2$ |
| Sodium Dihexyl-α-sulfosuccinate | 35 mg/m$^2$ |
| Sodium p-dodecylbenzenesulfonate | 32 mg/m$^2$ |

-continued

| | |
|---|---|
| $SnO_2/Sb$ (90/10, by weight; mean grain size, 0.25 μm) | 318 mg/m$^2$ |
| Composition of Backing Layer-Protecting Layer: | |
| Gelatin | 2.7 g/m$^2$ |
| Silicon Dioxide Mat Agent (mean grain size, 3.5 μm) | 26 mg/m$^2$ |
| Sodium Dihexyl-α-sulfosuccinate | 20 mg/m$^2$ |
| Sodium p-dodecylbenzenesulfonate | 27 mg/m$^2$ |
| Dye A 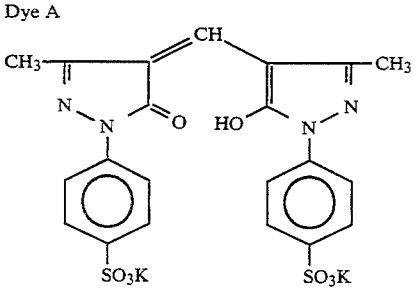 | 190 mg/m$^2$ |
| Dye B 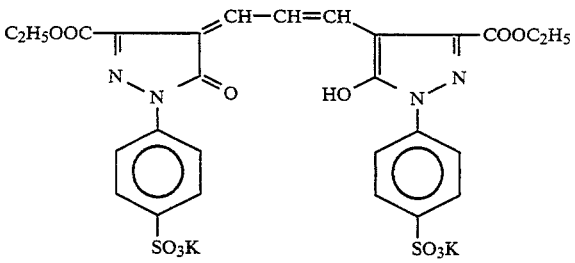 | 32 mg/m$^2$ |
| Dye C 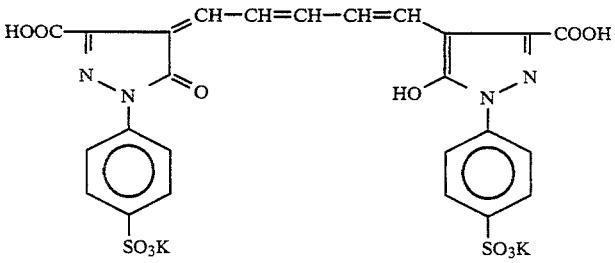 | 59 mg/m$^2$ |
| $C_8F_{17}SO_2N(C_3H_7)-(CH_2CH_2O)_n-(CH_2)_4-SO_3Li$ | 5 mg/m$^2$ |
| Ethyl Acrylate Latex (mean grain size, 0.05 μm) | 260 mg/m$^2$ |
| 1,3-Divinylsulfonyl-2-propanol | 150 mg/m$^2$ |

Over the emulsion layer, coated was a protective layer containing 1.5 g/m$^2$ of gelatin, the solid dispersion of the dye shown in Table 3 and, as coating aids, the following surfactant, stabilizer, dye and mat agent, and dried.

The amount of the solid dye to be added was adjusted in such a way that all the coated samples might have the same time as Sample No. II-1 in the test for safelight safety mentioned below.

| | |
|---|---|
| Surfactant: | |
| 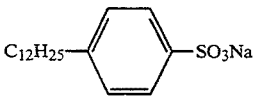 | 37 mg/m$^2$ |

-continued

| | |
|---|---|
| $CH_2COOC_6H_{13}$ / $CHCOOC_6H_{13}$ / $SO_3Na$ | 37 mg/m$^2$ |
| $C_8F_{17}SO_2N(C_3H_7)-CH_2COOK$ | 2.5 mg/m$^2$ |
| Stabilizer: | |
| Thioctic Acid | 2.1 mg/m$^2$ |
| Mat Agent: | |
| Polymethyl Acrylate (mean grain size, 2.5 μm) | 9.0 mg/m$^2$ |
| Silica (mean grain size, 4.0 μm) | 9.0 mg/m$^2$ |
| Dye: | |

-continued

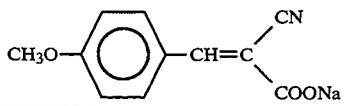

21 mg/m²

TABLE 3

| Sample No. | Dispersed Solid Dye |
|---|---|
| II-1 (sample of the invention) | Compound No. 3 (140 mg/m²) |
| II-2 (sample of the invention) | Compound No. 8 (140 mg/m²) |
| II-3 (comparative sample) | Comparative Compound No. 1 (140 mg/m²) |
| II-4 (comparative sample) | Comparative Compound No. 4 (140 mg/m²) |

According to the process mentioned above, photographic material samples (II-1 to II-4) were prepared.

Evaluation of Properties of Photographic Material Samples:

These samples were exposed through an optical wedge, using P-627FM Model Printer (equipped with F/L Type B Filter—made by Dai-Nippon Screen Co.), and processed with an automatic developing machine FG-710F Model (made by Fuji Photo Film Co.) using the following developer (I). The processing comprised development at 38° C. for 20 seconds, fixation, rinsing and drying in order.

The composition of the developer used is mentioned below.

| Composition of Developer: | |
|---|---|
| Potassium Hydroxide | 90.0 g |
| Sodium Hydroxide | 8.0 g |
| Disodium Ethylenediaminetetraacetate | 1.0 g |
| Boric Acid | 24.0 g |
| Sodium Metabisulfite | 65.0 g |
| Potassium Bromide | 10.0 g |
| Hydroquinone | 55.0 g |
| 5-Methylbenzotriazole | 0.40 g |
| N-methyl-p-aminophenol | 0.50 g |
| Sodium 2-mercaptobenzimidazole-5-sulfonate | 0.30 g |
| Sodium 3-(5-mercaptotetrazole)benzenesulfonate | 0.20 g |
| N-n-butyl-diethanolamine | 14.0 g |
| N,N-dimethylamino-6-hexanol | 0.20 g |
| Sodium Toluenesulfonate | 8.0 g |
| 5-Sulfosalicylic Acid | 23.0 g |
| Potassium Hydroxide and Water to make one liter and pH 11.9 | |
| (1) Sensitivity: | |
| The reciprocal of the amount of exposure to give a density of 0.1 was obtained for each sample, and the sensitivity of each sample was represented in terms of its relative value based on the sensitivity of Sample No. II-1 of being 100. | |
| (2) Safelight Safety: | |
| Each sample was exposed to an anti-fading fluorescent lamp (FLR 40SW-DL-X NU/M Model, made by Toshiba Co.) at about 400 lux, whereupon the safe time against the exposure was obtained. | |
| (3) Color Stains: | |
| Four sheets of each sample were piled up, and the color stains in their highlight area were determined by sensual evaluation. | |

In processing the samples, the line speed was so controlled that the development time might be 9 seconds by modifying the automatic developing machine, and the rinsing was effected at 10° C.

The evaluation of the samples was effected by five ranks mentioned below. "3" or higher ranks mean that the practical use of the sample will be possible with no problem.

5: No color stain appeared.

4: A few color stains appeared, but the practical use of the sample will be possible.

3: Some color stains appeared, but the practical use of the sample will be possible.

2: Many color stains appeared, and the practical use of the sample will be impossible.

1: Color stains appeared even in one sheet of the sample, and the practical use of the sample will be impossible.

The results obtained are shown in Table 4.

TABLE 4

| Sample No. | Dispersed Solid Dye | Sensitivity | Safelight Safety (min) | Color Stains |
|---|---|---|---|---|
| II-1 (sample of the invention) | Compound No. 3 (45 mg/m²) | 100 | 10 | 4 |
| II-2 (sample of the invention) | Compound No. 8 (50 mg/m²) | 100 | 10 | 5 |
| II-3 (comparative sample) | Comparative Compound No. 1 (55 mg/m²) | 40 | 10 | 2 |
| II-4 (comparative sample) | Comparative Compound No. 4 (45 mg/m²) | 36 | 10 | 3 |

As is noted from Table 4, Sample Nos. II-1 and II-2 the present invention had a high sensitivity to a determined safelight and had a few or no color stains after processed. The data in Table 4 indicate the excellent properties of these sample of the present invention.

While the invention has been described in detail and with reference to specific embodiments thereof, it will be apparent to one skilled in the art that various changes and modifications can be made therein without departing from the spirit and scope thereof.

What is claimed is:

1. A silver halide photographic material having a hydrophilic colloid layer containing a dispersion of fine solid grains of at least one compound represented by formula (1)

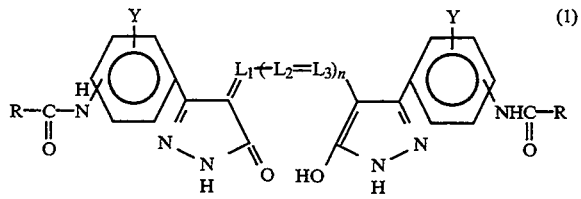

wherein

R represents an alkyl group, an aryl group, an amino group, an alkoxy group, an aryloxy group or a heterocyclic group;

$L_1$, $L_2$ and $L_3$ each represents a methine group;

Y represents a hydrogen atom, an alkyl group, an alkoxy group or a halogen atom;

R and Y may be bonded to each other to form a ring; and n represents an integer of from 0 to 2;

provided that R, Y, $L_1$, $L_2$ and $L_3$ do not have a group having an ionizable proton or its salt.

2. The silver halide photographic material as claimed in claim 1, wherein R in formula (1) is an alkyl group or an amino group.

3. The silver halide photographic material as claimed in claim 1, wherein the grains of the compound of formula (1) have a mean grain size of 10 μm or less.

4. The silver halide photographic material as claimed in claim 1, wherein Y is a hydrogen atom.

5. The silver halide photographic material as claimed in claim 1, wherein said at least one compound represented by formula (1) is used in an amount of from 0.5 to 1000 $mg/m^2$ of said hydrophic colloid layer.

* * * * *